US008656912B2

(12) United States Patent
Johannessen

(10) Patent No.: US 8,656,912 B2
(45) Date of Patent: Feb. 25, 2014

(54) BREATHING AIR UNIT

(75) Inventor: Øyvind Næss Johannessen, Rennesøy (NO)

(73) Assignee: E Innovation AS, Sandnes (NO)

( * ) Notice: Subject to any disclaimer, the term of this patent is extended or adjusted under 35 U.S.C. 154(b) by 0 days.

(21) Appl. No.: 13/513,116

(22) PCT Filed: Dec. 2, 2010

(86) PCT No.: PCT/NO2010/000441

§ 371 (c)(1),
(2), (4) Date: Jul. 24, 2012

(87) PCT Pub. No.: WO2011/071388

PCT Pub. Date: Jun. 16, 2011

(65) Prior Publication Data

US 2013/0042866 A1 Feb. 21, 2013

(30) Foreign Application Priority Data

Dec. 9, 2009 (NO) ..... 20093496

(51) Int. Cl.
*A62B 7/02* (2006.01)
*A62B 7/00* (2006.01)

(52) U.S. Cl.
USPC ..... 128/204.15; 128/200.24; 128/204.18; 128/204.21

(58) Field of Classification Search
CPC ..... A61M 2205/127; A61M 2025/1072; A61M 2025/1086; A61M 25/1011; A61M 2205/12; A61M 2230/04; A61M 25/10; A61M 15/0085; A61M 16/00; A61M 16/06; A61M 16/08; A61M 16/1075; A61M 16/16; A61M 16/18; A61M 1/1053; A61M 1/1698; A61M 1/3627; A61M 2001/1006; A61M 2001/1055; A61M 2001/1096; A61M 2001/122; A61M 2001/1625; A61M 2001/1629; A61M 2001/3632; A61M 2015/0023; A61M 2016/0672; A61M 2016/101; A61M 2016/108; A61M 2016/1085; A61M 2016/1095; A61M 2205/3306; A61M 2205/3653; A61M 2205/8206; A61M 2210/0662; A61M 2230/005; A61M 3/0229; A61M 3/0258; A62B 17/006; A62B 31/00; A62B 19/00; A62B 7/02; A62B 7/06; A62B 7/14
USPC ..... 128/200.24, 204.18, 204.21, 201.13, 128/203.17, 203.26, 203.27, 204.15, 128/204.16, 204.17; 607/104
See application file for complete search history.

(56) References Cited

U.S. PATENT DOCUMENTS

| | | | | | |
|---|---|---|---|---|---|
| 3,646,773 | A | * | 3/1972 | Falk et al. | 62/160 |
| 3,831,373 | A | * | 8/1974 | Flynt | 60/802 |
| 4,024,730 | A | * | 5/1977 | Bell et al. | 62/259.3 |
| 4,080,103 | A | * | 3/1978 | Bird | 417/3 |
| 4,181,126 | A | * | 1/1980 | Hendry | 128/201.21 |
| 4,981,023 | A | * | 1/1991 | Krishnakumar et al. | 62/498 |

(Continued)

FOREIGN PATENT DOCUMENTS

| | | | |
|---|---|---|---|
| DE | 4344353 | A | 6/1995 |
| DE | 4344353 | A1 | 6/1995 |
| DE | 20208771 | A | 7/2003 |
| DE | 20208771 | U1 | 7/2003 |
| JP | 8010331 | A | 10/1996 |
| JP | 11092105 | A | 4/1999 |
| JP | 2005304863 | A | 11/2005 |

*Primary Examiner* — Annette Dixon
(74) *Attorney, Agent, or Firm* — GableGotwals

(57) ABSTRACT

This invention relates to a breathing unit having an electric motor for driving a compressor, compressed air being conducted through a first heat exchanger cooled by cooling air of the compressor, and the compressed air being conducted through a second heat exchanger being cooled by cooling air of the motor.

5 Claims, 2 Drawing Sheets

(56) References Cited

U.S. PATENT DOCUMENTS 5,148,801 A * 9/1992 Douwens et al. ..... 128/203.16
5,174,285 A * 12/1992 Fontenot ..... 607/104
5,344,436 A * 9/1994 Fontenot et al. ..... 607/104
5,386,823 A * 2/1995 Chen ..... 128/204.15
5,572,880 A * 11/1996 Frustaci et al. ..... 62/259.3
5,678,421 A * 10/1997 Maynard et al. ..... 62/407
6,016,803 A * 1/2000 Volberg et al. ..... 128/205.26
8,424,337 B2 * 4/2013 Scarcella et al. ..... 62/470
2007/0089743 A1 * 4/2007 Hoffman ..... 128/204.18

* cited by examiner

BREATHING AIR UNIT

CROSS-REFERENCE TO RELATED APPLICATIONS

This application is the United States National Phase of PCT Patent Application No. PCT/NO2010/000441 filed 2 Dec. 2010, which claims priority to Norwegian Patent Application No. 20093496 filed 9 Dec. 2009, which are incorporated herein by reference.

BACKGROUND OF THE INVENTION

This invention concerns a breathing air unit. More particularly, the invention relates to a breathing air unit comprising a motor for driving a compressor, wherein compressed air is conducted through a first heat exchanger cooled by cooling air from the compressor.

Relatively strict authority requirements have been stipulated with respect to the quality of compressed air to be used as breathing air. With oil as a lubricant in a compressor chamber and as a coolant for other mechanical components in a compressor, there will always be a risk of getting oil vapour into the compressed air. The air from compressors of this type is therefore unsuitable as breathing air if not subjected to extensive filtering.

According to prior art, so-called oil-free compressors, normally in the form of piston compressors and certain screw compressors, are used for delivering breathing air. The oil-free compressor may form a part of a unit for delivering breathing air. Units of this is type are oftentimes of such a size that they resemble stationary installations.

During work on large constructions with significant distances involved, a need for relatively long pipe- and hose connections arises, which is labour-intensive and must be viewed in context of surrounding work with respect to the danger of breaks in the hose connections. Frequently these hose connections cause condensation and bacterial problems in the breathing air, hence result in an uncertain supply of breathing air to the user.

Moreover, examples of prior art within the area of breathing air units may be found in DE 4344353 A1 and JP 8010331 A.

DE 4344353 A1 discloses a portable breathing air unit, wherein the breathing air is cooled by means of a single heat exchanger. This heat exchanger is not cooled by means of the cooling fan of the motor or the cooling fan of the compressor.

JP 8010331 A concerns a breathing apparatus for medical use, wherein a scroll compressor is used in the breathing apparatus.

BRIEF SUMMARY OF THE INVENTION

The object of the invention is to remedy or reduce at least one of the disadvantages of the prior art.

The object is achieved in accordance with the invention and by virtue of the features disclosed in the following description and in the subsequent claims.

A breathing air unit comprising an electric motor for driving a compressor is provided, wherein compressed air is conducted through a first heat exchanger cooled by cooling air from the compressor. The breathing air unit is characterized in that the compressed air is conducted through a second heat exchanger cooled by cooling air from the motor.

The compressor may be comprised of a scroll compressor.

A scroll compressor frequently comprises two snail-shaped laminas/ribs, which are working against each other, and which are structured for oil-free delivery of pressurized air. Generally, the delivery of pressurized air is free of any pulsing. However, compressors of this type deliver pressurized air at a relatively high temperature. Accordingly, the general view in this field of expertise is that scroll compressors are unsuitable for delivering breathing air unless external elements are provided in order to cool the compressed air.

Advantageously, however, the scroll compressor is compact, as compared to oil-free piston compressors, with respect to the delivered amount of air. The inventor has succeeded in building a wheel-going, compact breathing air unit capable of being wheeled, by hand, onto the user location.

According to the invention, the superfluous heat is removed from the compressed air by virtue of conducting the compressed air through the second heat exchanger, which is cooled by cooling air of the motor. Advantageously, the motor's own cooling fan may be used for the purpose, but a separate fan may also be used. This technical solution contributes further to allowing a breathing air unit according to the invention to be provided in a relatively compact and lightweight design.

The second heat exchanger may be located upstream of the motor. By so doing, it is avoided that the cooling air is heated by the motor before the cooling air passes through the second heat exchanger.

The compressed air may be conducted, in a manner known per se, through conventional filters in order to satisfy current requirements with respect to purity and quality of breathing air.

The cooling air of the motor normally discharges from the motor in a known manner. In an alternative embodiment, the cooling air from the motor may be conducted through the first heat exchanger as an addition to the cooling air of the compressor.

The unit according to the invention renders possible to build a compact and relatively simple breathing air unit capable of easily being wheeled onto the user location.

BRIEF DESCRIPTION OF THE VIEWS OF THE DRAWINGS

Hereinafter, an example of a preferred embodiment is described and depicted in the accompanying drawings, wherein.

Figure 1:
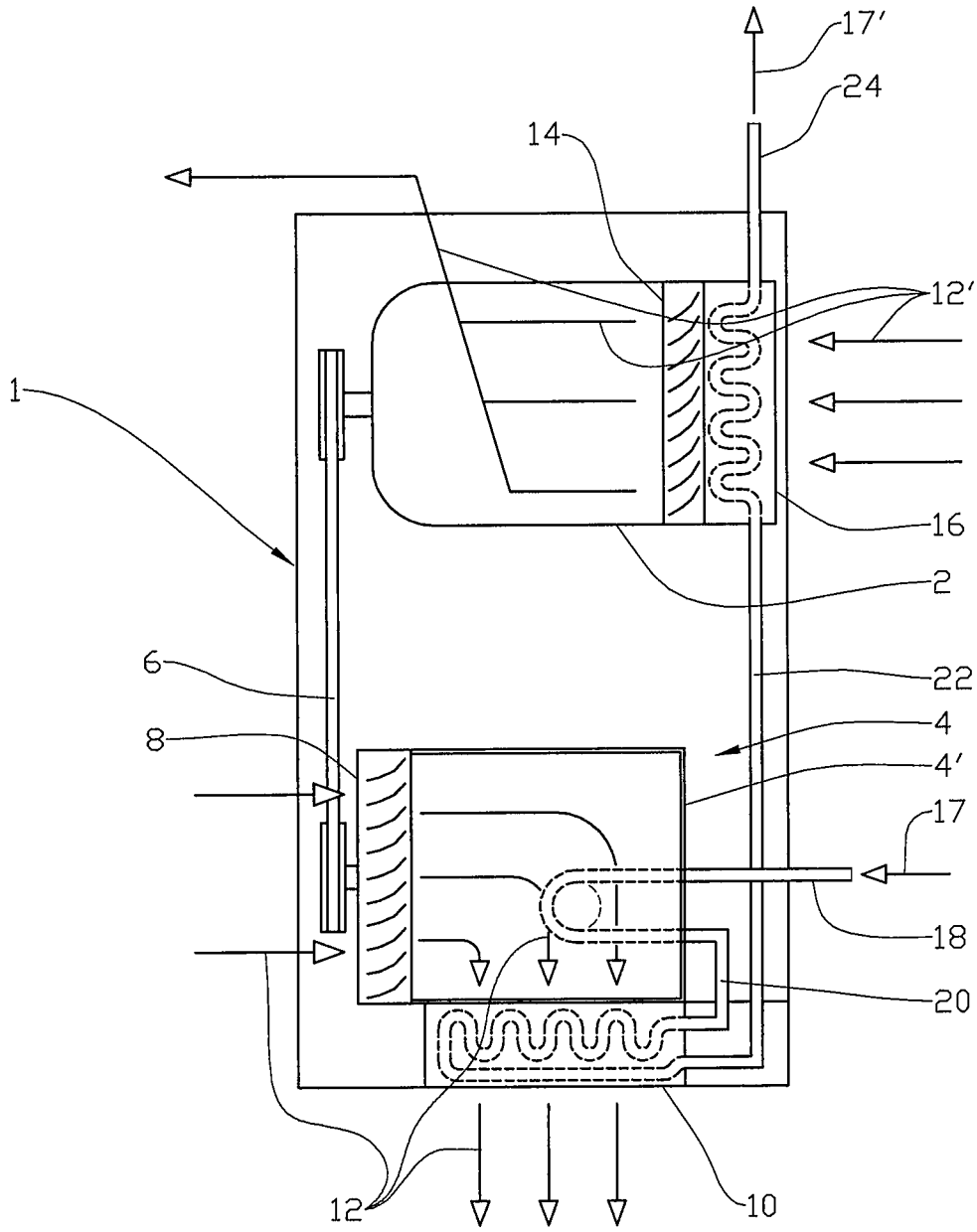
FIG. 1 shows a principle sketch of a breathing air unit according to the invention.

In the drawings, reference numeral 1 denotes a breathing air unit comprising an electric motor 2 and a compressor 4. The motor 2 drives the compressor 4 via a V-belt transmission 6.

DETAILED DESCRIPTION OF THE INVENTION

The compressor 4, which in this preferred embodiment is a scroll compressor with a compressor housing 4', is provided with a compressor fan 8. The compressor fan 8 is arranged in a manner allowing it to cause a first flow of cooling air 12 to flow through the compressor 4 when the compressor 4 is operating. The compressor fan 8 is also causes the first flow of cooling air 12 to flow through a first heat exchanger 10.

Arrows 12 in the figures show flow directions. The first flow of cooling air 12 flowing internally in the compressor housing and across the compressor 4 has only been insignificantly heated when flowing into the first heat exchanger 10.

The motor 2 is provided with a motor fan 14 drawing a second flow of cooling air 12' into the motor via an upstream second heat exchanger 16, the motor fan 14 being arranged in a manner allowing it to blow the second flow of cooling air 12' across the motor 2. The second heat exchanger 16 is connected in a sealing manner to the motor fan 14 in such a way that all of the second flow of air 12' flowing through the motor fan 14 also must flow through the second heat exchanger 16.

Figure 2:
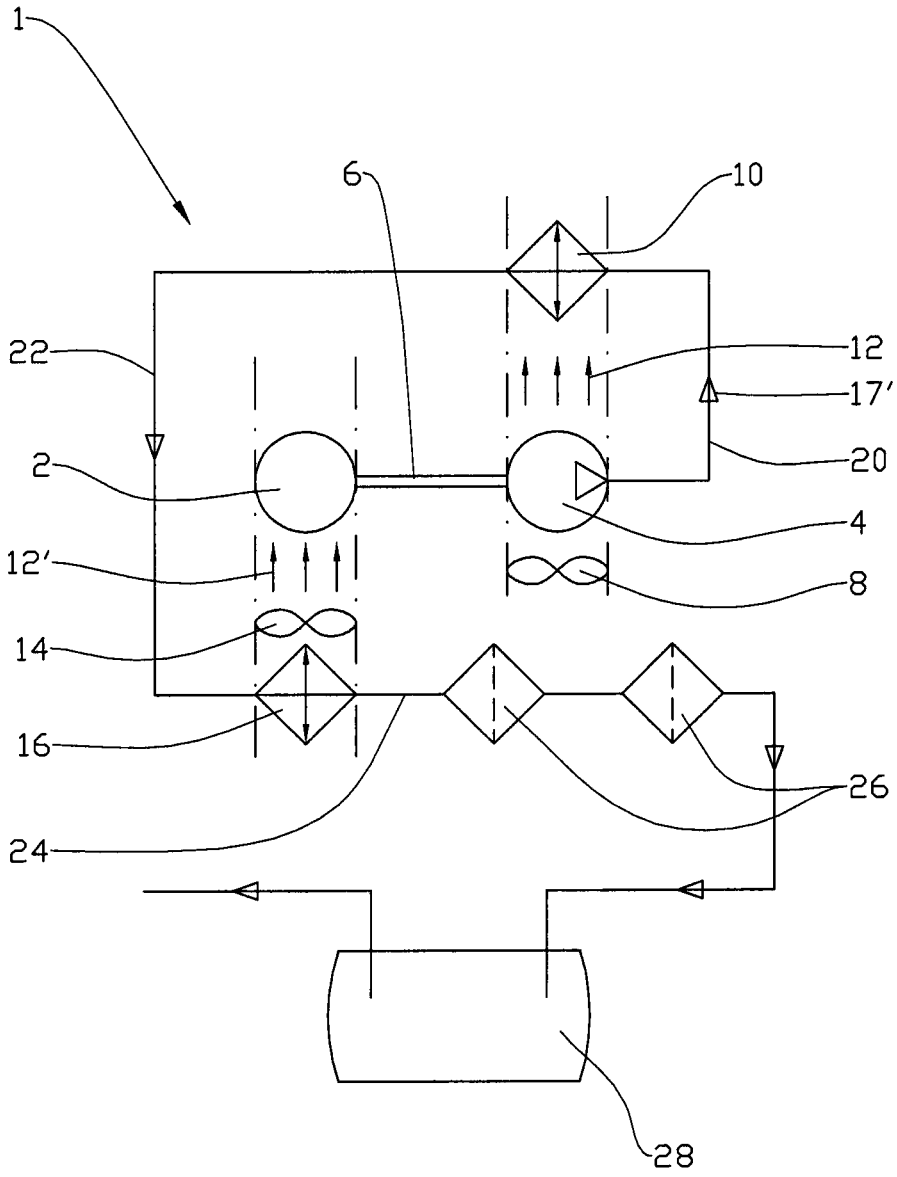
FIG. 2 shows a symbol diagram for the breathing air unit in FIG. 1.

Uncompressed breathable air 17, which is comprised of pre-filtered, ambient air, flows into the compressor 4 via an air inlet 18. Compressed breathable air 17' flows from the compressor 4 via a compressor pipe 20 and onto the first heat exchanger 10, and then onto the second heat exchanger 16 via an intermediate pipe 22. The compressed breathable air 17' flows from the second heat exchanger 16 via an outlet pipe 24 and onto, respectively, a water separator 26, a pressure vessel 28 and onwards via filters (not shown) and valves (not shown) onto a user (not shown); see FIG. 2.

Thus, the breathing air 17' compressed in the compressor 4 becomes cooled by means of the compressor cooling air 12 in the first heat exchanger 10, and then by the motor cooling air 12' in the second heat exchanger 16.

By so doing, the compressed breathable air 17' is cooled to a comfortable user temperature before reaching the user (not shown), and without having to pass through long hose- or pipe connections capable of causing condensation and bacterial problems.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is limited only by the scope of the attached claims, including the full range of equivalency to which each element thereof is entitled.

The invention claimed is:

1. A device for compressing and cooling breathable air, said device comprising:

a housing having arranged therein a compressor and a motor operatively connected to drive the compressor;

the compressor comprises a compressor housing with a compressor cooling fan mounted at a first end of the compressor housing, the compressor cooling fan being arranged to draw a first flow of cooling air into and through the interior of the compressor housing to cool the compressor, the first cooling air flow exiting the compressor housing and into a first heat exchanger in fluid communication therewith;

the motor comprises a motor cooling fan, the motor cooling fan being arranged to draw a second flow of cooling air across the motor to cool the motor;

a second heat exchanger sealingly connected to the motor cooling fan, whereby the second flow of cooling air drawn by the motor cooling fan must necessarily pass through the second heat exchanger;

a first inlet pipe arranged to introduce an ambient breathable air to the compressor, the compressor being arranged to compress the air;

a second pipe arranged to lead the compressed air from the compressor to the first heat exchanger;

a third pipe arranged to lead the compressed air from the first heat exchanger to the second heat exchanger; and a fourth outlet pipe arranged to lead the compressed air out of the housing, the compressed air being available to a user via the outlet pipe.

2. The device according to claim 1, wherein the compressor is a scroll compressor.

3. The device according to claim 1, wherein the second heat exchanger is located upstream of the motor in relation to a flow of cooling air generated by the motor cooling fan.

4. The device according to claim 1, wherein the device is a portable unit.

5. The device according to claim 1, wherein the motor comprises a motor cooling fan mounted at a first end of the motor.

* * * * *